US006148165A

United States Patent [19]

Visser et al.

[11] Patent Number: 6,148,165

[45] Date of Patent: Nov. 14, 2000

[54] APPARATUS WITH BIPOLAR PHOTOCONDUCTIVE ELEMENT FOR MAKING MULTICOLOR ELECTROPHOTOGRAPHIC IMAGES AND METHOD FOR PRODUCING IMAGES

[75] Inventors: Susan A. Visser, Rochester; Paul M. Borsenberger, Hilton; Donald S. Rimai, Webster, all of N.Y.

[73] Assignee: Eastman Kodak Company, Rochester, N.Y.

[21] Appl. No.: 09/070,290

[22] Filed: Apr. 30, 1998

[51] Int. Cl.[7] ..... G03G 15/08

[52] U.S. Cl. ..... 399/223; 347/118

[58] Field of Search ..... 399/231, 232, 399/223, 302, 308, 159; 430/42, 44, 47, 66, 67, 69, 83; 347/118

[56] References Cited

U.S. PATENT DOCUMENTS

| | | | |
|---|---|---|---|
| 3,028,365 | 4/1962 | Schnell et al. . | |
| 3,317,466 | 5/1967 | Caldwell et al. . | |
| 3,615,414 | 10/1971 | Light . | |
| 3,615,415 | 10/1971 | Gramza . | |
| 3,732,180 | 5/1973 | Gramza et al. . | |
| 4,108,412 | 8/1978 | Mey . | |
| 4,127,412 | 11/1978 | Rule et al. . | |
| 4,634,259 | 1/1987 | Oishi et al. | 399/231 X |
| 5,006,868 | 4/1991 | Kinoshita | 347/118 |
| 5,258,813 | 11/1993 | Nakahara et al. | 399/231 |
| 5,288,573 | 2/1994 | Hung et al. | 430/83 X |
| 5,347,303 | 9/1994 | Kovacs et al. . | |
| 5,444,463 | 8/1995 | Kovacs et al. | 347/118 |
| 5,525,447 | 6/1996 | Ikuno et al. | 430/67 |
| 5,532,801 | 7/1996 | Mizoguchi | 399/232 |

OTHER PUBLICATIONS

D.S. Weiss, J.R. Cowdery, W.T. Ferrar and R.H. Young, Proceedings of IS&T's Eleventh International Congress on Advances in Non–Impact Printing Technologies, 1995, 57.

*Primary Examiner*—Quana M. Grainger
*Attorney, Agent, or Firm*—Doreen M. Wells

[57] ABSTRACT

A method and an apparatus for producing, in a single pass, an electrophotographic image comprising at least two colors. The photoconductive element is bipolar, and has a single active layer and a protective layer of diamond-like carbon.

18 Claims, 2 Drawing Sheets

A
B
C
D

101

CHARGE

IMAGEWISE EXPOSE

DEVELOP

CHARGE

IMAGEWISE EXPOSE

DEVELOP

APPARATUS WITH BIPOLAR PHOTOCONDUCTIVE ELEMENT FOR MAKING MULTICOLOR ELECTROPHOTOGRAPHIC IMAGES AND METHOD FOR PRODUCING IMAGES

CROSS REFERENCE TO RELATED APPLICATIONS

The present invention is related to commonly assigned, concurrently filed U.S. Pat. application Ser. No. 09/070,259, filed , Apr. 30, 1998, entitled "Single Layer Bipolar Electrophotographic Element" of Visser et al. The disclosure of this related application is incorporated herein by reference.

FIELD OF THE INVENTION

This invention relates to an electrophotographic engine and process capable of producing images comprising at least two distinct toners (e.g. toners having different colors) on a single photoconductive element. More specifically, it allows such images to be made on a single layer aggregate photoconductive element comprising a diamond-like carbon layer.

BACKGROUND OF THE INVENTION

In a typical electrophotographic engine, images are formed by first charging a photoconductive element and then image-wise discharging that element using either an optical exposure or electronic means such as a laser scanner or light-emitting diode (LED) array. This forms an electrostatic latent image which is then developed into a visible image by passing the electrostatic latent image through an appropriate developer. The image is then transferred from the photoconductive element to a receiver, such as paper or transparency stock, by a suitable known means such as applying an electrostatic field. The image is then permanently fixed using a suitable process such as fusing. Color images are generally produced by forming images comprising color separations on separate frames of the photoconductive element and, subsequently, transferring them, in register, to a receiver.

The process of making color images as described significantly reduces the process speed of the electrophotographic engine because the process requires two or more sequential transfers to occur. In addition, in order to register the image, it is most advantageous to wrap the receiver around a drum. This can introduce registration errors due to variations in receiver and/or drum thickness. Moreover, thick receivers cannot be wrapped around drums and it is difficult to release thin receivers from drums.

These issues were addressed, in part, by Kinoshita (U.S. Pat. No. 5,006,868), who produced two-color images by first charging a photoconductive element, comprising a conductive layer, a photogeneration layer, and a dielectric layer, by forming first and second electrically charged, oppositely charged, polarized latent images and developing said latent images using two toners of opposite polarity. The toners were then similarly charged and transferred to a print medium. As is well known, however, dielectric layers on photoconductive elements prevent the element from photodischarging, thereby creating image artifacts. Kovacs and Connell, in U.S. Pat. Nos. 5,444,463 and 5,347,303, addressed the issue of the dielectric layer by using a similar process, but they substituted a photoconductive element comprising two charge generating layers, each sensitive to a different wavelength of light. This process requires multiple scanners with specific narrowly specified wavelengths of light and photoconductive elements with very narrow absorption bands. In practice, this can be difficult to achieve and maintain over the life of the device. In addition these requirements make this process totally unsuitable for an engine with an optical exposure.

There is nothing in the prior art that teaches an electrophotographic apparatus or process capable of producing multiple-colored images that can be developed with a single rotation or pass of the photoconductive element and that also overcomes the problems of image artifacts and the necessity for exposure to multiple narrowly specified wavelengths of light.

SUMMARY OF THE INVENTION

The present invention overcomes these difficulties by using a photo-conductive element that produces an image of two colors in a single rotation or pass of a photoconductive element, said element comprising, in order, a conductive support, a single photoconductive layer comprising an aggregate material, and a diamond-like carbon (DLC) outermost layer, wherein the thickness of the DLC layer is between 0.05 and 0.5 micrometers ($\mu$m). The DLC layer in this thickness range has the unexpected ability to conduct both positive and negative charge adequately to prevent the aforementioned image artifacts without being so conductive as to generate lateral image spread (LIS).

In one embodiment of the invention there is provided a method of producing an electrophotographic image comprising at least two colors, the method comprising the steps of:

a) providing a bipolar photoconductive element;

b) charging said bipolar photoconductive element to a surface potential of a first element polarity;

c) image-wise exposing said charged photoconductive element to create a first electrostatic latent image;

d) developing said first latent image using a first toner of a first color having an electrostatic charge of a first toner polarity, said first toner polarity being selected from (1) the same, and (2) the opposite of the first element polarity in step b);

e) charging said photoconductive element to a surface potential of a second element polarity which is opposite the first element polarity in step b);

f) image-wise exposing the photoconductive element charged in step e) to create a second electrostatic latent image; and g) developing said second latent image using a second toner of a second color having an electrostatic charge of a polarity which is i) the opposite of the second element polarity if (1) was elected in step d); or ii) the same as the second element polarity if (2) was elected in step d).

It is known that single layer aggregate organic photoconductive elements can be charged and discharged either positively or negatively. However, the charge deposited on such a photoconductive element tends to decay quickly, thereby precluding its use in many electrophotographic engines. In addition the photogenerative layer is fragile and easily damaged during the operation of the engine.

Thus, in order that a photoconductive element be suitable for use in the aforementioned process, it must be bipolar, not exhibit unacceptable dark decay either initially or after being exposed to charging and/or exposure, not have a high residual voltage, and be resistant to physical damage such as punctures, wear, and abrasion. The examples below show that the elements and processes of the present invention are suitable for formation of multicolor images and can do so in a single rotation or pass of the photoconductive element.

DETAILED DESCRIPTION OF THE INVENTION

Figure 1A:
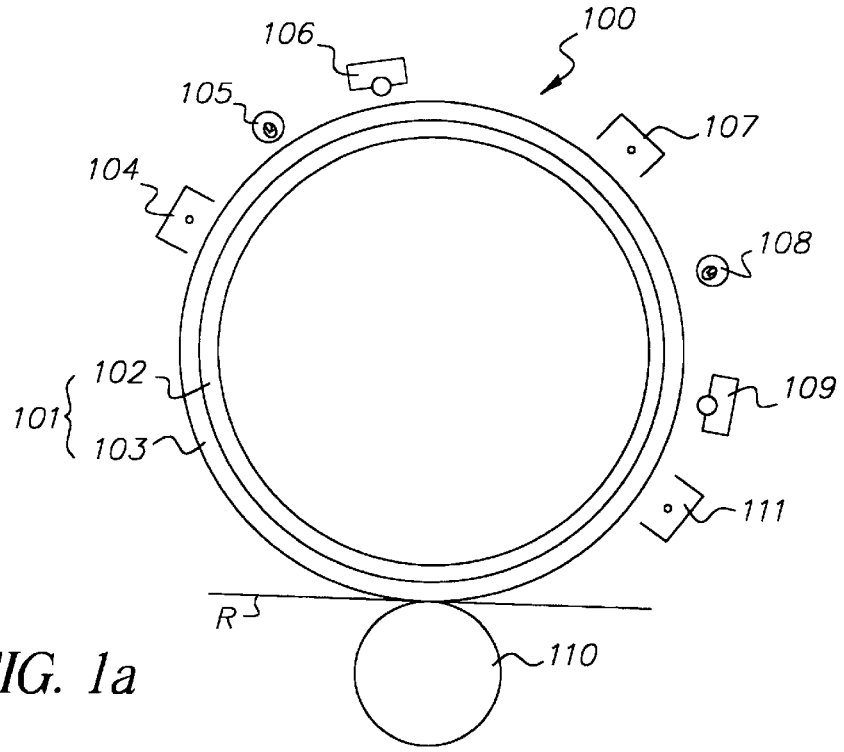
FIGS. 1A–B are schematic illustrations of the apparatus of the present invention.

In one embodiment of the invention, a bipolar photoconductive element having a diamond-like carbon outermost layer is provided and first and second toners of opposite charge polarity are used. The photoconductive element preferably comprises a conductive support, a single layer aggregate photoconductive layer, and a diamond-like carbon layer. The photoconductive element is charged to a surface potential of a first element polarity and then is image-wise exposed to create a first electrostatic latent image. The first latent image is developed using a first toner of a first color having an electrostatic charge of a first toner polarity which may be the same as or different than the first element polarity. The photoconductive element is charged to a surface potential of a second element polarity that is opposite to the first element polarity and then is image-wise exposed to create a second electrostatic latent image. The second electrostatic latent image is developed using a second toner of a second color having an electrostatic charge that is opposite to the first toner polarity. Next, the polarity of the charge on the second toner image is reversed. In this manner, both the first and second toned images are of the same polarity. Transfer can then be accomplished by a method that is known in the art. It is preferred that the first and second toners be differently colored.

In an alternative embodiment, toner particles of the same charge polarity can be used. In this instance the photoconductive element is charged to some polarity. For example, assuming the toner particles are charged positively, the photoconductive element is then charged positively to a potential of, say, +500 volts. The development station is biased to a potential of approximately +400 volts. In this scenario, the toner would be deposited in only the discharged areas of the photoconductive element. The second toner would also be charged positively. The photoconductive element, however, would be charged negatively to, say, −500 volts. The development station would be biased to a smaller potential of, say, −100 volts. In this manner the toner forming the second image would be deposited in only the unexposed or charged areas. Transfer can then be accomplished without having to reverse the sign of the toner particles.

The apparatus to produce images using the methods described herein can be as follows. A single-layer photoconductive element bearing a DLC overcoat, also known as a diamond-like carbon outermost layer, as described herein, is electrically charged using a suitable charging device such as a corona or roller charger, as is known in the art. The image is then image-wise exposed using either an optical exposure or an electronic exposure, using a laser scanner, LED array, or other means, as is known in the art. The electrostatic latent image thus formed is then developed by bringing the latent image bearing photoconductive element into proximity with a suitable development station, as are described herein.

The photoconductive element is again charged, as has been described earlier in this disclosure, and again image-wise exposed and brought into proximity with a second development station. For this purpose a single charging element can be used. In this case the polarity of the charger may have to be reversed. However, it is preferred to use two chargers so as to maximize efficiency of the engine.

The second image is then developed in register with the first. To avoid scavenging the already developed image and contaminating the developer, it is preferred that the second development process be noncontacting, such as can be accomplished using aerosol development. However, more conventional techniques can also be used.

The image is then transferred to a suitable receiver and fused using known technology. A full color image comprising at least two, and preferably at least three or four color separations can be made by making two such images on separate parts or frames of the photoconductive element or on two separate photoconductive elements and transferring the images to the receiver sequentially but in register. Alternatively, the images can be transferred to a suitable intermediate member. In this case, the two images described above can be made on the same frame or area of the photoconductive element sequentially.

In some embodiments of this invention, it is necessary to reverse the charge on the previously toned image. This is most readily done using a post-development corona charger. While a simple charger would suffice, it is preferable to control the amount of charge deposited onto the toned image using a grid controlled charger. Even finer charge control can be obtained using a direct current (DC) biased alternating current (AC) grid controlled corona charger. The image is transferred using known technology such as a corona transfer, biased roller transfer, etc. Alternatively, other suitable transfer means such as thermal transfer can be employed.

While a variety of development technologies are suitable for use with this method, it is preferable to use a noncontacting method of development such as aerosol development or powder cloud development to prevent scavenging of the first toned image during the second development step.

While this process is most suitable for spot-color images comprising two colors, full color images can also be made by developing two such images on two separate frames and sequentially transferring the two 2-color images in register to a receiver.

The processes and apparatus of this invention require a specific photoconductive element. Photoconductive elements can comprise single or multiple active layers. In a single layer photoconductive element, charge generation (the photogeneration of charge carriers, i.e. electrons and holes) and charge transport (the transportation of the generated charge carriers) take place within the same layer. Single active layer aggregate photoconductive elements are described in Light, U.S. Pat. No. 3,615,414, and in Gramza et al., U.S. Pat. Nos. 3,732,180 and 3,615,415. Single active layer aggregate photoconductive compositions have found many commercial applications.

In order to be useful in an electrophotographic process, a photo-conductive element must display good photosensitivity and low residual voltage after exposure. Photosensitivity is a measure of the amount of energy that must be supplied during exposure to discharge the element in an image-wise fashion. The photosensitivity of a photoconductive element is characterized by a parameter known as sensitivity. Sensitivity is the reciprocal of the energy required to discharge the photoconductive element from an initial potential to a final potential that is half the initial potential, for example from an initial potential of 500V to a final potential of 250 V. Sensitivity is measured in $cm^2$/erg. When the polarity of the charging potential is positive, the sensitivity is denoted $S^+$. When the polarity of the charging potential is negative, the sensitivity is denoted $S^-$.

Residual voltage is a measure of the charge remaining on the element after exposing the element and allowing the charge on the element to decay. High residual voltages can give rise to lower potential differences between charged and discharged areas of the element on subsequent imaging cycles. Blurred, fogged, or incomplete images can result. For high process efficiency, high photosensitivity and low residual voltage are desired.

One problem associated with photoconductive elements is a phenomenon known as dark decay. Dark decay describes the decrease in the voltage on the element between the time that it is charged by the charging device and the time that it is exposed to image-wise radiation. Dark decay reduces the potential difference between the charged and discharged areas of the photoconductive element after exposure and can result in improper placement of toner on the image. The result is blurred lines, fogging, and other undesirable artifacts in the final image. Particularly in electrophotographic processes that seek to reproduce high quality images, dark decay is a major limiting factor to preparing a useful photoconductive element. It is especially important that photoconductive elements do not exhibit an increase in dark decay following one or more cycles comprising charging and exposing of said photoconductive element.

Most known photoconductive elements display useful electrophotographic properties, including good photosensitivity, low residual voltage, and acceptable dark decay, only when subjected to one polarity (positive or negative) of charging. These are known as monopolar photoconductive elements. A monopolar photoconductive element designed for use with positive charging will have high photosensitivity when exposed to light after being charged positively; however, the element will have little or no photosensitivity if it is charged negatively prior to exposure with light. A similar situation occurs for monopolar photoconductive elements designed for use with negative charging. This produces a limitation on the usefulness of these types of photoconductive elements in many electrophotographic processes.

A bipolar photoconductive element is a photoconductive element that, when charged positively, displays a sensitivity within a factor of two of the sensitivity displayed by the element when it is charged negatively. If the sensitivity of the element when it is charged positively is denoted $S^+$, and the sensitivity of the element when it is charged negatively is $S^-$, the photoconductive element is a bipolar photoconductive element if $S^+=\alpha S^-$, where $\alpha$ varies from 0.5–2.0 and $S^+$ and $S^-$ are measured in $cm^2$/erg. Bipolar photoconductive elements are particularly useful in the processes and apparatus of the present invention.

The photoconductive layer of the photoconductive element used in the process and apparatus of this invention contains materials, preferably organic and more preferably organic photoconducting materials, that make the layer capable of bipolar charge generation and transport. This means that the layer is capable of generating and transporting charge carriers under both positive and negative charging. Suitable charge generation materials include dye polymer aggregates, phthalocyanines, squaraines, perylenes, azo-compounds, and trigonal selinium particles. Charge transport materials capable of accepting either negative charges, electrons, or positive charges, holes, are known. Hole transport materials are often characterized by having donor functionalities. Common hole transport materials include arylalkanes, arylamines, hydrazones, and pyrazolines. Electron transport materials often are characterized by having acceptor functionalities. Examples of electron transport materials include diphenoquinones and 2,4,7-trinitro-9-fluorenene. An appropriate combination of charge generation and charge transport materials could be devised to produce a bipolar single photoconductive layer.

A bipolar single photoconductive layer can be produced using charge-transfer complexes of poly(N-vinylcarbazole) :2,4,7-trinitro-9-fluorenone, which are capable of both electron and hole transport.

It is preferred that the bipolar single photoconductive layer be comprised of an aggregate photoconductive composition. A layer comprised of an aggregate photoconductive composition is known as a single layer aggregate photoconductive layer. An aggregate photoconductive material is a material containing a finely divided, particulate photoconductive co-crystalline complex of at least one aggregating dye and at least one aggregating binder polymer. An aggregating dye is a dye, preferably of the pyrylium type, that forms a photoconductive co-crystalline complex with an aggregating binder polymer. An aggregating binder polymer is a polymer having an alkylidene diarylene repeating unit, preferably a polycarbonate, that forms a photoconductive co-crystalline complex with an aggregating dye.

In the manufacture of the preferred bipolar single photoconductive layer, an aggregate photoconductive composition is coated and dried on an electrically conductive support. The support can be in the form of a plate, sheet, web, or drum and can be, for example, a metallic or non-metallic plate, sheet, web, or drum that has an electrically conductive surface.

Electrically conductive supports include, for example, paper (equilibrated to a relative humidity above 50 percent); aluminum-paper laminates; metal foils such as aluminum foil, zinc foil, etc.; metal plates, such as aluminum, copper, zinc, brass and galvanized plates; vapor deposited metal layers such as silver, chromium, nickel, aluminum and the like coated on paper or conventional photographic film supports, such as cellulose acetate, polystyrene, poly (ethylene terephthalate), etc. Such conductive materials as chromium, aluminum, or nickel can be vacuum deposited on transparent film supports in sufficiently thin layers to allow electrophotographic elements prepared therewith to be exposed from either side of such elements.

In a preferred method for preparing the aggregate composition in the method of the invention, one or more binder polymers, at least one of which is an aggregating polymer, are dissolved in an organic solvent. To this mixture is added a seed composition, which contains small preformed aggregate particles that are nucleating sites for the formation of the dye-polymer aggregate composition. To the resulting mixture are added selected aggregating dyes, organic charge transport agents, and preferably, a coating aid.

Pyrylium type dyes, especially thiapyrylium and selenapyrylium dyes, are useful in forming the aggregate compositions. Useful dyes are disclosed in Light, U.S. Pat. No. 3,615,414, incorporated herein by reference.

Particularly useful in forming the aggregates are pyrylium dyes having the formula:

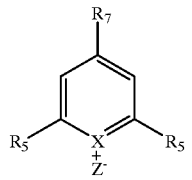

wherein:

$R_5$ and $R_6$are phenyl groups;

$R_7$ is a dimethylamino substituted phenyl group;

X is selenium, sulfur, or tellurium; and

Z is an anion such as perchlorate, tetrafluoroborate, or hexafluoroborate.

The polymers useful in forming the aggregate compositions are electrically insulating, film-forming polymers having an alkylidenediarylene group in a recurring unit such as those linear polymers disclosed in Light, U.S. Pat. No. 3,615,414 and Gramza et al., U.S. Pat. No. 3,732,180, incorporated herein by reference.

Preferred polymers for forming aggregate compositions are hydrophobic carbonate polymers containing the following group in a recurring unit:

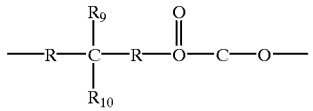

wherein each R is a phenylene group; and $R_9$ and $R_{10}$ are each methyl or, taken together, represent a norbomyl group. Such compositions are disclosed, for example, in U.S. Pat. Nos. 3,028,365 and 3,317,466. Especially preferred are polycarbonates prepared with bisphenol-A. A wide range of film-forming polycarbonate resins are useful, with satisfactory results being obtained when using commercial polymeric materials which are characterized by an inherent viscosity of about 0.5 to about 1.8. Specific examples of useful polymers for the aggregate compositions are listed in Table I, Column 13 of U.S. Pat. No. 4,108,657, incorporated herein by reference.

Preferred organic charge transport agents are triarylamines such as tri-p-tolylamine and amino-substituted polyarylalkane photoconductive materials represented by the formula:

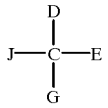

wherein D and G, which may be the same or different, represent aryl groups and J and E, which may be the same or different, represent a hydrogen atom, an alkyl group, or an aryl group, at least one of D, E, and G containing an amino substituent. Especially useful is a polyarylalkane wherein J and E represent a hydrogen atom, an aryl, or an alkyl group, and D and G represent substituted aryl groups having as a substituent thereof a diarylamino group wherein the aryl groups are groups such as tolyl. Additional information concerning certain of these latter polyarylalkanes can be found in Rule et al., U.S. Pat. No. 4,127,412.

The aggregate composition is filtered and coated on a substrate. Any technique for coating these uniform layers on a substrate can be used. When the substrate is a flat surface such as a sheet, plate, or web, suitable coating methods include extrusion hopper coating, curtain coating, reverse roll coating, and the like. For coating a drum substrate, a ring coater advantageously is used. After coating, the photoconductive layer on the substrate is dried, for example, by heating in an oven at a temperature from about 80° C. to about 140° C.

The next step in preparation of photoconductive elements useful in this invention is deposition of the DLC layer. The DLC layer is also known as an amorphous carbon layer or a plasma-polymerized amorphous carbon layer. The DLC layer used in this invention may contain fluorine at a concentration of between 0 and 65 atomic percent based on the composition of the entire DLC layer without loss of desirable properties. When fluorine is included in the film composition, the protective layer may also be called a fluorinated diamond-like carbon (F-DLC), fluorinated amorphous carbon, or plasma-polymerized fluorocarbon layer. The DLC layer is preferably formed by plasma-enhanced chemical vapor deposition (PE-CVD), using an alternating current (AC) or direct current (DC) power source. The AC supply preferably operates in the radio or microwave frequency range. Selection of PE-CVD processing parameters, such as power source type or frequency, system pressure, feed gas flow rates, inert diluent gas addition, substrate temperature, and reactor configuration, to optimize product properties is well known in the art. The DLC layer may comprise a single layer having a uniform composition or one or more multiple layers of non-uniform compositions; however, it is preferred that the DLC layer is a single layer having a uniform composition. Further, the protective layer can be formed by a single or multiple passes through, for example, the PE-CVD apparatus or reactor; however, it is preferred that the protective layer is formed by a single pass through the PE-CVD apparatus or reactor. PE-CVD reactors are commercially available from, for example, PlasmaTherm, Inc.

Layers formed using plasma-assisted methods tend to be highly crosslinked films that do not exhibit long range order or a characteristic repeat unit like conventional polymers.

As noted, the atomic percent of fluorine in the protective layer can be between 0 and 65 atomic percent. The atomic percent of fluorine in the protective layer can be determined using X-Ray Photoelectron Spectroscopy (XPS). This is a well known technique for analyzing the composition of thin films. A typical measurement is described in detail in Example 1.

Feed gases that are preferred to be used to prepare the plasma-polymerized coatings, that is, the DLC layer, used in this invention include sources of carbon.

Sources of carbon include hydrocarbon compounds. The preferred hydrocarbon compounds include paraffinic hydrocarbons represented by the formula $C_nH_{2n+2}$, where n is 1 to 10, preferably 1 to 4; olefinic hydrocarbons represented by formula $C_nH_{2n}$, where n is 2 to 10, preferably from 2 to 4; acetylenic hydrocarbons represented by $C_nH_{2n-2}$, where n is 2 to 10, preferably 2; alicyclic hydrocarbons; and aromatic compounds. This list includes, but is not limited to, the following: methane, ethane, propane, butane, pentane, hexane, heptane, octane, isobutane, isopentane, neopentane, isohexane, neohexane, dimethylbutane, methylhexane, ethylpentane, dimethylpentane, tributane, methylheptane, dimethylhexane, trimethylpentane, isononane and the like; ethylene, propylene, isobutylene, butene, pentene, methylbutene, heptene, tetramethylethylene, hexene, octene, allene, methyl-allene, butadiene, pentadiene, hexadiene, cyclopentadiene, ocimene, alloocimene, myrcene, hexatriene, acetylene, allylene, diacetylene, methylacetylene, butyne, pentyne, hexyne, heptyne, octyne, and the like; cyclopropane, cyclobutane, cyclopentane, cyclohexane, cycloheptane, cyclooctane, cyclopropene, cyclobutene, cyclopentene, cyclohexene, cycloheptene, cyclooctene, limonene, terpinolene, phellandrene, sylvestrene, thujene, carene, pinene, bornylene, camphene, tricyclene, bisabolene, zingiberene, curcumene, humalene, cadinenesesquibenihene, selinene, caryophyllene, santalene, cedrene, camphorene, phyllocladene, podocarprene, mirene, and the like; benzene, toluene, xylene, hemimellitene, pseudocumene, mesitylene, prehnitene, isodurene, durene, pentamethyl-benzene, hexamethylbenzene, ethylbenzene, propylbenzene, cumene, styrene, biphenyl, terphenyl, diphenylmethane, triphenylmethane, dibenzyl, stilbene, indene, naphthalene, tetralin, anthracene, phenanthrene, and the like. The hydrocarbon compounds need not always be in their gas phase at room temperature and atmospheric pressure, but can be in a liquid or solid phase insofar as they can be vaporized on melting, evaporation, or sublimation, for example, by heating or in a vacuum, in order to yield a gas phase of the hydrocarbon compound.

The preferred feed gases used to prepare DLC layers containing fluorine would include sources of fluorine and carbon. Fluorocarbon compounds include but are not limited to paraffinic fluorocarbons represented by the formula $C_nF_xH_y$, where n is 1 to 10, preferably 2 to 4, x+y=2n+2, and x is 3 to 2n+2, preferably 2n+2; olefinic fluorocarbons represented by the formula $C_nF_xH_y$, where n is 2 to 10, preferably 2 to 4, x+y=2n, and x is 2 to 2n, preferably 2n; acetylenic fluorocarbons represented by $C_nF_xH_y$, where n is 2 to 10 preferably 2, x+y=2n−2, and x is 1 to 2n−2, preferably 2n−2; alkyl metal fluorides; aryl fluorides having from 6 to 14 carbon atoms; alicyclic fluorides, preferably perfluorinated alicyclic compounds, having from 3 to 8 carbon atoms, preferably from 3 to 6 carbon atoms; styrene fluorides; fluorine-substituted silanes; fluorinated ketones; and fluorinated aldehydes. These fluorocarbon feed compounds may have a branched structure. Examples include hexafluoroethane; tetrafluoroethylene; tetrafluoroethane; pentafluoroethane; octafluoropropane; 2H-heptafluoropropane; 1H-heptafluoropropane; hexafluoropropylene; 1,1,1,3,3,3-hexafluoropropane; 1,1,1,2,2,3-hexafluoropropane; 1,1,1,2,3,3-hexafluoropropane; 2-(trifluoromethyl)-1,1,1,3,3,3-hexafluoropropane; 3,3,3-trifluoropropyne; 1,1,1,3,3-pentafluoropropane; 1,1,1,3,3-pentafluoropropene; 1,1,1,2,2-pentafluoropropane; 3,3,3-trifluoropropyne; decafluorobutane; octafluorobutene; hexafluoro-2-butyne; 1,1,1,4,4,4-hexafluorobutane; 1,1,1,4,4,4-hexafluoro-2-butene; perfluoro(t-butyl)acetylene; dodecafluoropentane; decafluoropentene; 3,3,4,4,4-pentafluorobutene-1; perfluoroheptane; perfluoroheptene; perfluorohexane; 1H,1H,2H-perfluorohexene; perfluoro-2,3,5-trimethyl-hexene-2; perfluoro-2,3,5-trimethylhexene-3; perfluoro-2,4,5-trimethylhexene-2; 3,3,4,4,5,5,5-heptafluoro- 1-pentene; decafluoropentene; perfluoro-2-methylpentane; perfluoro-2-methyl-2-pentene, perfluoro-4-methyl-2-pentene, hexafluoroacetone, perfluorobenzene, perfluorotoluene, perfluorostyrene, hexafluorosilane, dimethylaluminum fluoride, trimethyltin fluoride, and diethyltin difluoride. The fluorocarbon compounds need not always be in their gas phase at room temperature and atmospheric pressure, but can be in a liquid or solid phase insofar as they can be vaporized on melting, evaporation, or sublimation, for example, by heating or in a vacuum, in order to yield the fluorocarbon compound in its gas phase.

Note that these fluorocarbon compounds can also serve as feed gases for producing non-fluorinated DLC coatings, assuming that changes in process conditions or in post-process treatment are used to ensure that no fluorine remains in the final coatings.

Paraffinic, fully fluorinated fluorocarbons and mixtures thereof are preferred. Olefinic or acetylinic hydrocarbons or mixtures thereof are preferred. Hydrogen is usually incorporated into the films in the form of the hydrogen present in the hydrocarbon feed gas. Pure hydrogen may also be used as an additional feed gas. Mixtures of two or more types of hydrocarbons can be used with one or more fluorocarbon compounds. Mixtures of one or more fluorocarbons, one or more hydrocarbons, and hydrogen can be used.

The presence of hydrogen is not required but may be included without loss of desirable properties. Oxygen may also be incorporated into the films from the feed gas or from atmospheric oxygen gained through reaction with free radicals present in the coating as it is removed from the reactor. Oxygen may be included without loss of desirable properties, although it is preferred that the oxygen concentration remain below 25 atomic percent based on the composition of the entire DLC layer.

Inert gases such as argon, helium, neon, xeon, or the like optionally may be fed into the reactor during the deposition of the protective layers in order to control the properties of the coating. The use of inert gases to control coating properties is well known to those skilled in the art.

The thickness of the DLC layer is preferably between about 0.05 and 0.5 micrometers, more preferably between about 0.15 and 0.35 micrometers.

The usefulness in the process and apparatus of this invention of a photoconductive element comprising, in order, a conductive support, a single photoconductive layer comprising an aggregate photoconductive material, and a DLC layer, wherein the thickness of the DLC is between 0.05 and 0.5 $\mu$m, is demonstrated in the examples below. The examples demonstrate that such an element can be charged negatively or positively to give acceptable photosensitivity, residual voltage, and dark decay without displaying lateral image spread over a wide range of ambient humidities. Thus, this element can be used in the process and apparatus of this invention to overcome the problems of the prior art.

FIG. 1A schematically depicts apparatus 100 of the present invention, which includes a photoconductive element 101 having a single layer aggregate photoconductive layer 102 and a diamond-like carbon outermost layer 103. Apparatus 100 also includes a first charging unit 104 comprising means for charging photoconductive element 101 to a surface potential of a first polarity, a first exposing unit 105 comprising means for imagewise exposing charged photoconductive element 101 to produce a first electrostatic latent image, and a first developing unit 106 comprising means for developing the first latent image to a first toned image, using a first toner whose polarity can be either the same as or opposite to the polarity of the potential on photoconductive element 101 produced by first charging unit 104.

Photoconductive element 101 is charged by a second charging unit 107 that comprises means for charging element to a surface potential of a second polarity that is opposite to that produced by first charging unit 104. A second exposing unit 108 comprising means for imagewise exposing charged photoconductive element 101 produces a second electrostatic latent image, which is developed by a second developing unit 109 that comprises means for developing the second latent image to a second toned image. The second toned image is formed by a toner having the same polarity as that of the surface potential produced by second charging unit 107 if the polarities of the surface potential produced by first charging unit 104 and the first toner were the same. If these latter polarities were opposite, the toner for the second toned image will be of opposite polarity to the surface potential produced by second charging unit 107.

Apparatus 100 includes a transfer-fixing station 110 that comprises means for transferring and fixing the toned images to a receiver R. Apparatus 100 can further include mean 111 for reversing the polarity of the charged second toned image.

Figure 1B:
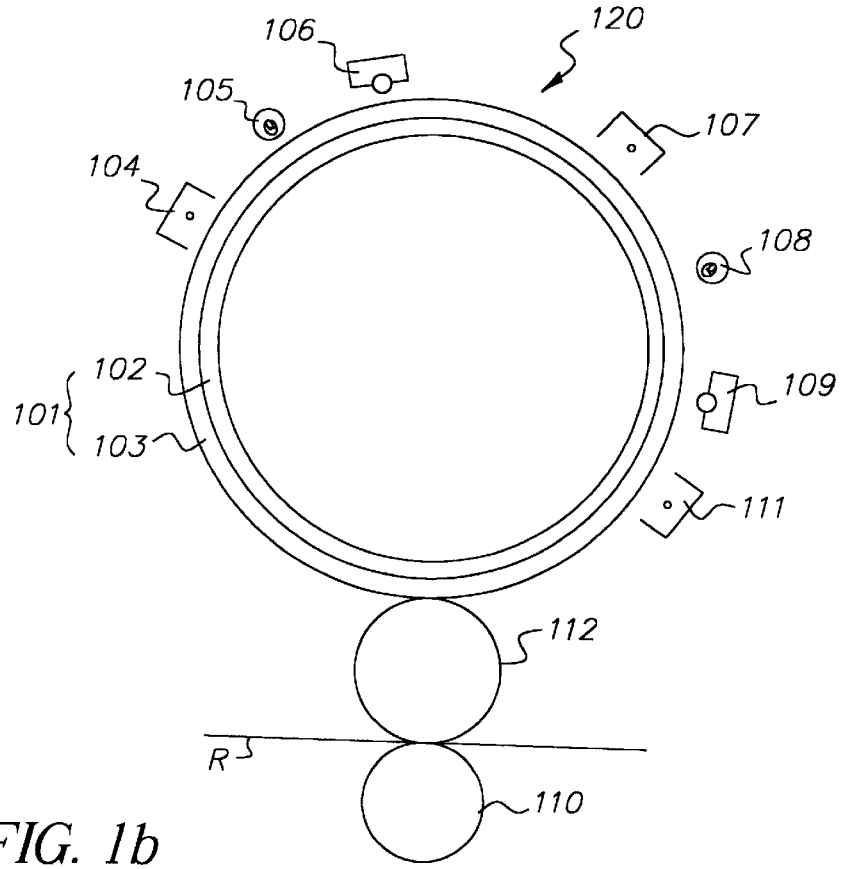

FIG. 1B schematically depicts apparatus 120 of the invention, which differs from apparatus 100 of FIG. 1A in including an intermediate member 112.

Figures 2A, 2B, 2C, 2D, 2E, 2F, 2G:
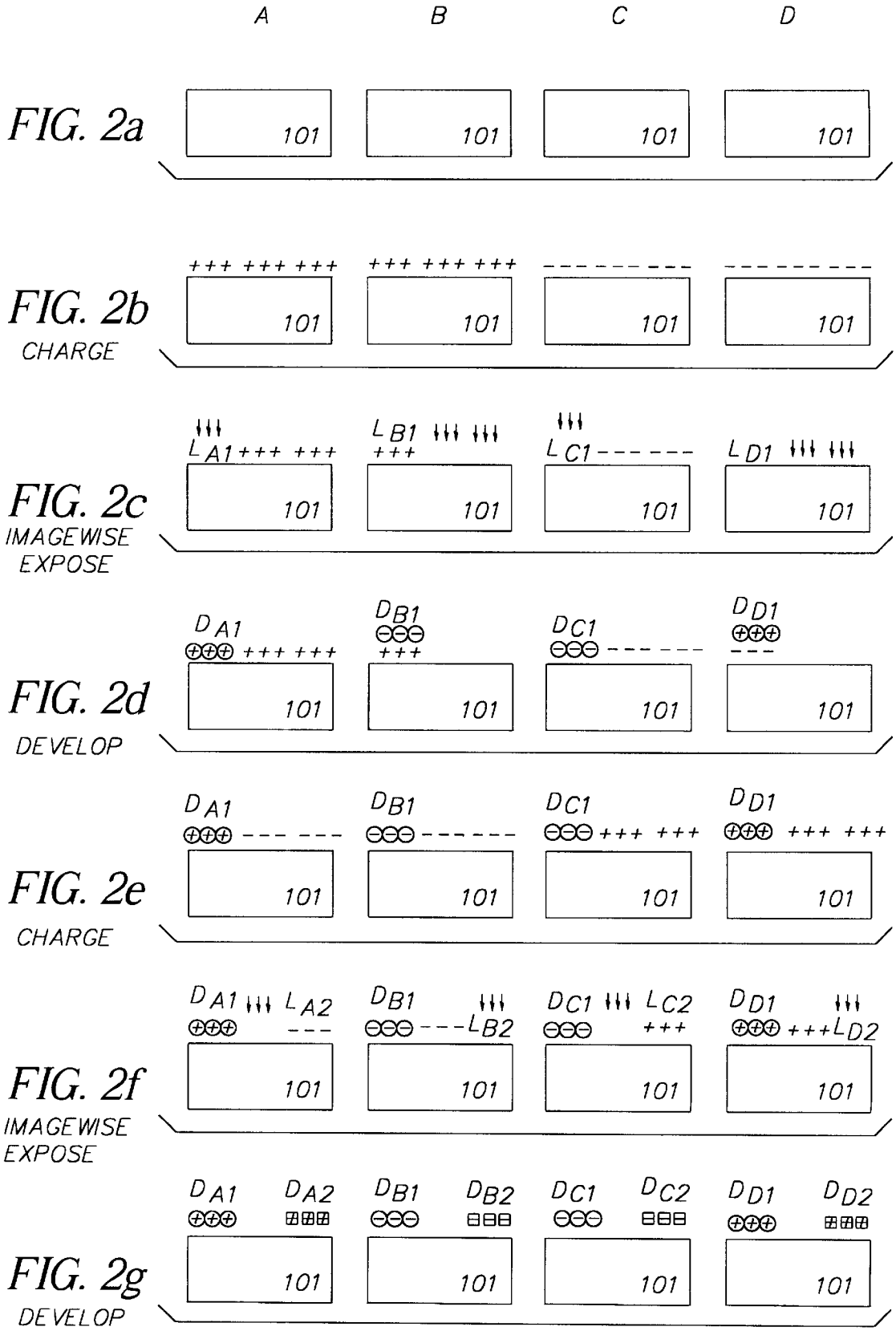
FIG. 2 schematically depicts the steps of the method of the present invention.

In FIG. 2 is schematically depicted four embodiments, A–D, of the process of the present invention, steps a) through g) of claim 1, for forming a multicolor image on a bipolar photoconductive element 101. In embodiment A, element 101 is uniformly charged to a positive polarity, then imagewise exposed to create in the exposed portion a first latent image $L_{A1,}$ which is developed using a positively charged first toner to form a first toned image $D_{A1}$. Elememnt 101 is then charged to an opposite, negative polarity and imagewise exposed to create in the unexposed portion of element 101 a second latent image $L_{A2}$, which is developed using a second positively charged toner to form a second toned image $D_{A2}$.

In embodiment B, element 101 is uniformly charged to a positive polarity, then imagewise exposed to create in the unexposed portion a first latent image $L_{B1}$, which is developed using a negatively charged first toner to form a first toned image $D_{B1}$. Element 101 is then charged to an opposite, negative polarity and imagewise exposed to create in the exposed portion of element 101 a second latent image $L_{B2}$, which is developed using a second negatively charged toner to form a second toned image $D_{A2}$.

In embodiment C, element 101 is uniformly charged to a negative polarity, then imagewise exposed to create in the exposed portion a first latent image $L_{C1}$, which is developed using a negatively charged first toner to form a first toned image $D_{C1}$. Element 101 is then charged to an opposite, positive polarity and imagewise exposed to create in the unexposed portion of element 101 a second latent image $L_{C2}$, which is developed using a second negatively charged toner to form a second toned image $D_{C2}$.

In embodiment D, element 101 is uniformly charged to a negative polarity, then imagewise exposed to create in the unexposed portion a first latent image $L_{D1}$, which is developed using a positively charged first toner to form a forst toned image $D_{D1}$. Elemnet 101 is then charged to an opposite, positive polarity and imagewise exposed to create in the exposed portion of element 101 a second latent image $L_{D2}$, which is developed using a second positively charged toner to form a second toned image $D_{D2}$.

The following examples and comparative examples further describe the invention.

EXAMPLES

Example 1

Bipolar Single Layer Photoconductive Element Having a Diamond-Like Carbon Protective Layer A A bipolar single layer photoconductive element was prepared using an aggregate photoconductive layer as follows. The aggregate photoconductive layer formulation was prepared at room temperature. The aggregating dyes were first dissolved in the solvent mixture; the binding polymers and organic charge transport agents were then added. After all the materials were in solution, then seed was added. A phenylmethyl-substituted siloxane with a viscosity of 50 centistokes (DC-510 polysiloxane, obtained from Dow Corning) was used as a coating aid in the formulation. The resulting solution was filtered first through a 2.5 $\mu$m, then through a 0.6 $\mu$m filter. The formulation used is listed in Table 1 below.

TABLE 1

Aggregate photoconductive layer composition

| Chemical name | Wt. % | Grams |
|---|---|---|
| Lexan ™ 145 polycarbonate | 26.8 | 243.6 |
| Makrolon ™ 5705 polycarbonate | 26.8 | 243.6 |
| Seed | 0.5 | 4.5 |
| Polyester dimethyl terephthalatelethylene glycol/neo-pentylglycol | 2 | 18.2 |
| 4-((4-dimethylaminophenyl)-2,6-diphenyl)-6-phenyl thiapyrylium hexafluorophosphate | 3.2 | 29.1 |
| 4-(4-dimethylaminophenyl)-2-(4-ethoxyphenyl)-6-phenyl thiapyrylium tetrafluoroborate | 0.8 | 7.3 |
| 1,1-bis(di-4-tolylaminophenyl)cyclohexane | 17.9 | 162.7 |
| tri-p-tolylamine | 17.9 | 162.7 |
| DC-510, phenylmethyl substituted siloxane | 0.18 | 1.6 |
| Dichloromethane | 70 | 567 |
| 1,1,2-trichloroethane | 30 | 242 |

The seed used in the formulation listed in Table 1 was prepared as follows:

To a mixture of 1155 grams of dichloromethane and 493.5 grams of 1,1,2-trichloroethane was added 8.04 grams of 4-((4-dimethylaminophenyl)-2,6-diphenyl)-6-phenyl thiapyrylium tetrafluoroborate and 5.36 grams of 4-(4-dimethylaminophenyl)-2-(4-ethoxyphenyl)-6-phenyl thiapyrylium tetrafluoroborate. The mixture was stirred mechanically for one hour; to the resulting solution was added 102 grams of high molecular weight bisphenol A polycarbonate, (Makrolon™ 5705 polycarbonate, obtained from Mobay Chemical Co.). After one hour additional stirring, 238 grams of bisphenol A polycarbonate of lower molecular weight (Lexan™ 145 polycarbonate, obtained from General Electric Co.) was added. The mixture was stirred overnight, then diluted with 211.5 grams of 1,1,2-trichloroethane. The resulting slurry was allowed to evaporate to dryness, and the residue was cut into small pieces. The high molecular weight polycarbonate referred to above was Makrolon™ 5705 polycarbonate, obtained from Mobay Chemical Co. Its number average molecular weight, as determined by gel permeation chromatography, is 178,000 polystyrene equivalents. The low molecular weight polycarbonate above was Lexan™ 145 polycarbonate, obtained from General Electric Co. Its number average molecular weight as determined by gel permeation chromatography is 51,600 polystyrene equivalents. The aggregate photoconductive layer formulation was coated onto a 7 mil thick nickel-coated poly(ethylene terephthalate) support and allowed to dry and cool.

A commercial parallel-plate plasma reactor (PlasmaTherm Model 730) was used for deposition of the diamond-like carbon (DLC) layer onto the photoconductive element whose preparation was described above. The DLC layer was deposited on the aggregate photoconductive layer. The deposition chamber consisted of two 0.28 meter outer diameter electrodes, a grounded upper electrode and a powered lower electrode. The chamber walls were grounded, and the chamber is 0.38 meter in diameter. Removal of heat from the electrodes was accomplished via a fluid jacket. Four outlet ports (0.04 cubic meters), arranged 90° apart on a 0.33 meter-diameter circle on the lower wall of the reactor, lead the gases to a blower backed by a mechanical pump. A capacitance manometer monitored the chamber pressure that was controlled by an exhaust valve and controller. A 600 W generator delivered radio-frequency (RF) power at 13.56 MHz through an automatic matching network to the reactor. The gases used in the deposition flowed radially outward from the perforated upper electrode in a showerhead configuration in the chamber. The single layer photoconductive element to which the DLC layer was to be applied was adhered to the lower electrode for deposition using double-stick tape. The element was coated at room temperature. The DLC layer was deposited on the photoconductive layer of the single layer photoconductive element.

The DLC layer was deposited onto the photoconductive layer of the photoconductive element by introducing 32 standard cubic centimeters per minute (sccm) acetylene, and 116 sccm argon into the reactor. The reactor pressure and RF power were 13.2 Pa and 100 W, respectively. Deposition time was 4.7 minutes.

Thickness of the DLC Layer

Simultaneous deposition of the DLC layer on a silicon wafer allowed measurement of coating thickness using ultraviolet/visible (UV/VIS) reflectometry. The thickness of the DLC layer was measured to be 0.20 $\mu$m.

Composition of the DLC Layer

The composition of the DLC layer of Example 1 was analyzed using X-ray photoelectron spectroscopy (XPS). The XPS spectra were obtained on a Physical Electronics 5601 photoelectron spectrometer with monochromatic A1 K$\alpha$X-rays (1486.6 eV). All spectra were referenced to the C 1s peak for neutral (aliphatic) carbon atoms, which was assigned a value of 284.6 eV. Spectra were taken at a 45° electron takeoff angle (ETOA) which corresponds to an analysis depth of about 5 nm. Note that XPS is unable to detect hydrogen. The XPS results are presented in Table 2.

Lateral Image Spread

Lateral image spread (LIS) of the photoconductive element of Example 1 was measured using the method described by D. S. Weiss, J. R. Cowdery, W. T. Ferrar, and R. H. Young, *Proceedings of IS&T's Eleventh International Congress on Advances in Non-Impact Printing Technologies* 1995, 57, at low ambient relative humidity (RH) conditions (30–40% relative humidity) and at high ambient relative humidity (70% relative humidity) conditions.

The LIS measurement initially produces a square wave pattern in a plot of surface potential versus distance. For a photoconductive element experiencing LIS, as the image spreads, the corners of the square wave become rounded, and the width of the wave broadens. The width of the pattern is determined by drawing tangents to the sides of the wave and measuring the distance between the two tangents at the points where they intersect the baseline drawn between the unimaged portions of the wave. The width of the surface potential wave (image width) is measured as a function of time to determine LIS. The result corresponding to no latent image spread would be an invariant image width as a function of time. Lower image widths and no change in image width as a function of time or of humidity are the desired results. The results of this type of LIS measurement can be correlated with performance of the photoconductor in an electrophotographic imaging machine. Results of the LIS measurements for Example 1 appear in Tables 3 and 4.

Sensitivity Testing

Photoinduced discharge measurements (sensitivity testing) were performed to measure the photosensitivity, residual voltage, and dark decay of the element. This involved charging the photoconductive element to an absolute value of the potential of 500 V in the dark, then exposing the photoconductive element to 680 nm radiation, and monitoring the change in voltage as a function of time. The sensitivity ($cm^2$/erg) is defined as the reciprocal of the energy required to discharge the photoconductor from 500 V to 250 V and is denoted as $S^+$ when the polarity of the initial charge is positive and $S^-$ when the polarity of the initial charge is negative. The residual voltage is the final voltage on the photoconductive element and is denoted as $V_r^+$ when the polarity of the initial charge is positive and $V_r^-$ when the polarity of the initial charge is negative. An increase of approximately 6% in residual voltage is expected when a coating is applied to a photoconductive element due to reflection losses introduced by the coating. The dark decay of the sample was measured by charging the sample to 500 V and monitoring the decrease in voltage without exposure to light over a 15 second period. Lower exposure energies, residual voltages, and dark decays are more desirable. Sensitivity testing was performed using positive and negative initial charging for the element. The results are shown in Table 5.

Resistance to Charger-Induced Damage

A photoconductive element in an electrophotographic process will typically be exposed to a charging element for significantly less than one millisecond per process cycle. However, over many cycles or passes through the electrophotographic process, cumulative exposure time to charging elements will be on the order of tens of minutes. To be useful in for long process lifetimes in the electrophotographic process and apparatus of this invention, it is necessary that the photoconductive element not be irreversibly damaged by prolonged or repeated exposure to the charging elements.

The test used here measures the ability of the photoconductive element to maintain its properties after repeated exposure to charging elements during cycling in the electrophotographic process. This is a test of the resistance of the element to charger-induced damage. The resistance of the coated photoconductive element of Example 1 to charger-induced damage was determined by placing the sample in front of a corona charging unit at 7 kV for 20 minutes, with the DLC protective layer facing the charging unit, and then measuring the photosensitivity as described above. Results of the photosensitivity testing after charging element exposure appear in Table 6.

Example 2

Bipolar Single Layer Photoconductive Element Having a Diamond-Like Carbon Layer B The photoconductive element of this Example was made as described in Example 1 except that the DLC layer contained fluorine and was deposited using the following gas types, flow rates, and deposition time. Inert argon gas was introduced at a flow rate of 96 sccm, and the reactive gases acetylene and hexafluoroethane were introduced into the reaction chamber at flow rates of 24 sccm and 8 sccm, respectively. Deposition time was 5.2 minutes.

Thickness of the DLC layer was 0.22 $\mu$m, determined as described in Example 1.

The composition determination of the DLC layer, LIS measurements, sensitivity testing, and resistance to charger-induced damage for this example were performed as described in Example 1. The results appear in Tables 2–6.

Example 3

Bipolar Single Layer Photoconductive Element Having a Diamond-Like Carbon Layer C The photoconductive element of this Example was made as described in Example 1 except that the layer contained fluorine and was deposited using the following gas types, flow rates, and deposition time. Inert argon gas was introduced at a flow rate of 64 sccm, and the reactive gases acetylene and hexaflourothane were introduced into the reaction chamber at flow rates of 16 sccm each. Deposition time was 4.7 minutes.

Thickness of the DLC layer was 0.17 $\mu$m, determined as described in Example 1.

The composition determination of the DLC layer, LIS measurements, sensitivity testing, and resistance to charger-induced damage for this example were performed as described in Example 1. The results appear in Tables 2–6.

Example 4

Bipolar Single Layer Photoconductive Element Having a Diamond-Like Carbon Layer D The photoconductive element of this Example was made as described in Example 1 except that the DLC layer contained fluorine and was deposited using the following gas types, flow rates, and deposition time. Inert argon gas was introduced at a flow rate of 32 sccm, and the reactive gases acetylene and hexafluoroethane were introduced into the reaction chamber at flow rates of 8 sccm and 24 sccm, respectively. Deposition time was 3.6 minutes.

Thickness of the DLC layer was 0.16 $\mu$m, determined as described in Example 1.

The composition determination of the DLC layer, LIS measurements, sensitivity testing, and resistance to charger-induced damage for this example were performed as described in Example 1. The results appear in Tables 2–6.

Example 5

Bipolar Single Layer Photoconductive Element Having a Diamond-Like Carbon Layer E The photoconductive element of this Example was made as described in Example 1 except that the DLC layer contained fluorine and was deposited using the following gas types, flow rates, and deposition time. Inert argon gas was introduced at a flow rate of 12.8 sccm, and the reactive gases acetylene and hexafluoroethane were introduced into the reaction chamber at flow rates of 3.2 sccm and 28.8 sccm, respectively. Deposition time was 3.6 minutes.

Thickness of the DLC layer was 0.16 $\mu$m, determined as described in Example 1.

The composition determination of the DLC layer, LIS measurements, sensitivity testing, and resistance to charger-induced damage for this example were performed as described in Example 1. The results appear in Tables 2–6.

Comparative Example 1

Bipolar Single Layer Photoconductive Element with no DLC Layer

The bipolar single layer photoconductive element of the Example was prepared as described in Example 1 except that no DLC layer was deposited on the surface of the photoconductive element.

The LIS measurements, sensitivity testing, and resistance to charger-induced damage for this Comparative Example were performed as described in Example 1. The results appear in Tables 3,5, and 6.

TABLE 2

COMPOSITION OF THE PROTECTIVE LAYER

| Example or | Elemental Composition | | |
|---|---|---|---|
| Comparative Example | Carbon (%) | Fluorine (%) | Oxygen (%) |
| Ex. 1 | 90.1 | 0 | 8.9 |
| Ex. 2 | 86.5 | 3.7 | 8.9 |
| Ex. 3 | 77.2 | 13.7 | 8.5 |
| Ex. 4 | 56.6 | 37.7 | 5.0 |
| Ex. 5 | 46.4 | 49.9 | 3.2 |

TABLE 3

LIS MEASURED AT LOW AMBIENT RELATIVE HUMIDITY CONDITIONS (45–48% RH)

| Time | Image width (mm) | | | | | |
|---|---|---|---|---|---|---|
| (sec) | Ex. 1 | Ex. 2 | Ex. 3 | Ex. 4 | Ex. 5 | Comp. Ex. 1 |
| 0 | 2.99 | 2.99 | 2.99 | 3.04 | 2.99 | 3.02 |
| 60 | 2.99 | 2.99 | 3.01 | 2.95 | 3.01 | 3.01 |
| 150 | 2.97 | 3.02 | 3.01 | 2.95 | 3.06 | 3.01 |
| 300 | 3.01 | 2.97 | 3.01 | 2.97 | 3.02 | 3.01 |
| 600 | 3.01 | 3.01 | 3.01 | 2.99 | 3.01 | 3.02 |
| 1200 | 2.97 | 2.99 | 3.01 | 2.99 | 3.05 | 3.01 |
| 1800 | 2.99 | 2.97 | 3.02 | 3.02 | 3.04 | 2.99 |

TABLE 4

LIS MEASURED AT HIGH AMBIENT RELATIVE HUMIDITY (65–73% RH)

| Time | Image width (mm) | | | | |
|---|---|---|---|---|---|
| (sec) | Ex. 1 | Ex. 2 | Ex. 3 | Ex. 4 | Ex. 5 |
| 0 | 3.04 | 3.02 | 3.02 | 2.99 | 3.01 |
| 60 | 3.04 | 2.99 | 3.01 | 3.02 | 2.97 |
| 150 | 3.02 | 2.99 | 3.01 | 3.02 | 2.99 |
| 300 | 3.04 | 3.04 | 3.01 | 3.02 | 2.99 |
| 600 | 3.01 | 3.04 | 3.02 | 3.04 | 3.01 |
| 1200 | 2.99 | 3.04 | 3.01 | 3.02 | 3.01 |
| 1800 | 3.01 | 3.02 | 2.97 | 3.04 | 3.02 |

TABLE 5

SENSITIVITY TESTING RESULTS

| Example or Comparative Example | $S^+$ ($cm^2$/erg) | $V_r^+$ (V) | Dark decay under positive initial charging (V) | $S^-$ ($cm^2$/erg) | $V_r^-$ (V) | Dark decay under negative initial charging (V) |
|---|---|---|---|---|---|---|
| Ex. 1 | 0.294 | 37 | 15 | 0.217 | 12 | 0 |
| Ex. 2 | 0.303 | 30 | 15 | 0.213 | 18 | 0 |
| Ex. 3 | 0.270 | 31 | 12 | 0.227 | 20 | 0 |
| Ex. 4 | 0.313 | 32 | 3 | 0.244 | 16 | 0 |
| Ex. 5 | 0.313 | 37 | 5 | 0.294 | 15 | 0 |
| Comp. Ex. 1 | 0.392 | 32 | 13 | 0.250 | 12 | 0 |

TABLE 6

SENSITIVITY TESTING RESULTS AFTER EXPOSURE TO CORONA CHARGING ELEMENT

| Example or Comparative Example | $S^+$($cm^2$/erg) | $S^-$($cm^2$/erg) |
|---|---|---|
| Ex. 1 | 0.323 | 0.192 |
| Ex. 2 | 0.333 | 0.204 |
| Ex. 3 | 0.333 | 0.213 |
| Ex. 4 | 0.345 | 0.256 |
| Ex. 5 | 0.385 | 0.256 |
| Comp. Ex. 1 | —* | 0.208 |

* Poor charge acceptance and dark decay properties of the element made it incapable of being charged to +500 V, indicating loss of useful function.

The invention has been described in detail with particular reference to certain preferred embodiments thereof, but it will be understood that variations and modifications can be effected within the spirit and scope of the invention.

What is claimed is:

1. A method of producing an electrophotographic image comprising at least two colors, said method comprising, in order, the steps of:

a) providing a bipolar photoconductive element;

b) charging said bipolar photoconductive element to a surface potential of a first element polarity;

c) image-wise exposing said charged photoconductive element to create a first electrostatic latent image;

d) developing said first latent image using a first toner of a first color having an electrostatic charge of a first toner polarity, said first toner polarity being selected from (1) the same, and (2) the opposite of the first element polarity in step b);

e) charging said photoconductive element to a surface potential of a second element polarity which is opposite the first element polarity in step b);

f) image-wise exposing the photoconductive element charged in step e) to create a second electrostatic latent image; and g) developing said second latent image using a second toner of a second color having an electrostatic charge of a polarity which is i) the opposite of the second element polarity if (1) was elected in step d); and ii) the same as the second element polarity if (2) was elected in step d).

2. A method of producing an electrophotographic image comprising at least two colors, said method comprising, in order, the steps of:

a) providing a bipolar photoconductive element having a diamond-like carbon outermost layer;

b) charging said bipolar photoconductive element to a surface potential of a first element polarity;

c) image-wise exposing said charged photoconductive element to create a first electrostatic latent image;

d) developing said first latent image to form a charged first toned image using a first toner of a first color having an electrostatic charge of a first toner polarity, said first toner polarity being selected from (1) the same, and (2) the opposite of the first element polarity in step b);

e) charging said photoconductive element to a surface potential of a second element polarity which is opposite the first element polarity in step b);

f) image-wise exposing the photoconductive element charged in step e) to create a second electrostatic latent image;

g) developing said second latent image to form a charged second toned image using a second toner of a second color having an electrostatic charge of a polarity which is i) the same as the second element polarity if (1) was elected in step d); and ii) opposite the second element polarity if (2) was elected in step d); and h) reversing the polarity of the charge on the second toned image.

3. The method of claim 1 or 2 further comprising the steps of:

i.) transferring both toned images in register to a receiver; and j.) fixing said toned image on said receiver.

4. A method according to claim 1 or 2 wherein first and second toned images are on a single frame of the photoconductive element.

5. A method according to claim 3 wherein the image is transferred to an intermediate member.

6. A method according to claim 1 or 2 wherein the developing steps are completed using a noncontacting method of development.

7. An apparatus for producing an electrophotographic image comprising at least two colors, said apparatus comprising:

a) a photoconductive element having a single layer aggregate photoconductive layer and having a diamond-like carbon outermost layer;

b) a means of charging said photoconductive element to a surface potential of a first polarity;

c) a means of image-wise exposing said photoconductive element to create a first electrostatic latent image;

d) a means of developing said first latent image to form a charged first toned image;

e) a means of charging said photoconductive element to a surface potential of a second polarity opposite said first polarity;

f) a means of image-wise exposing said photoconductive element to create a second electrostatic latent image;

g) a means of developing said second latent image to form a charged second toned image;

wherein all of the said means are arranged to carry out their function in the order (a) through (g).

8. An apparatus according to claim 7 further comprising a means of reversing the polarity of the charged second toned image.

9. An apparatus according to claim 7 further comprising i) a means for transferring a toned image to a receiver; and j) a means for fixing said image to a receiver.

10. A apparatus according to claim 7, 8 or 9 further comprising an intermediate transfer member.

11. A method according to claim 1 or 2 wherein the bipolar photoconductive element comprises a conductive support, a bipolar single photoconductive layer, and an diamond-like carbon outermost layer.

12. A method according to claim 11 wherein said diamond-like carbon outermost layer has a fluorine content of between 0 and 65 atomic percent based on the composition of said outermost layer.

13. A method according to claim 11 wherein the thickness of said diamond-like carbon outermost layer is between 0.05 and 0.5 $\mu$m.

14. A method according to claim 1 or 2 wherein the bipolar photoconductive element comprises, in order:

a) a conductive support;

b) a bipolar single photoconductive layer comprising:

i) an aggregate photoconductive material comprising an electrically insulating, continuous polymer phase and heterogeneously dispersed therein a complex of (a) at least one polymer having an alkylidene diarylene group in a recurring unit, and (b) at least one pyrylium dye salt, and ii) at least one organic charge transport agent in said continuous polymer phase; and c) a diamond-like carbon layer.

15. An apparatus according to claim 7, 8, or 9 wherein the photoconductive element comprises a conductive support, a single layer aggregate photoconductive layer, and a diamond-like carbon outermost layer.

16. An apparatus according to claim 7, 8, or 9 wherein said diamond-like carbon outermost layer has a fluorine content of between 0 and 65 atomic percent based on the composition of layer.

17. An apparatus according to claim 7, 8, or 9 wherein the thickness of said diamond-like carbon outermost layer is between 0.05 and 0.5 $\mu$m.

18. An apparatus according to claim 7, 8, or 9 wherein the photoconductive element comprises, in order:

a) a conductive support;

b) a single layer aggregate photoconductive layer comprising:

i) an aggregate photoconductive material comprising an electrically insulating, continuous polymer phase and heterogeneously dispersed therein a complex of (a) at least one polymer having an alkylidene diarylene group in a recurring unit, and (b) at least one pyrylium dye salt, and ii) at least one organic charge transport agent in said continuous polymer phase; and c) a diamond-like carbon outermost layer.

* * * * *

UNITED STATES PATENT AND TRADEMARK OFFICE

CERTIFICATE OF CORRECTION

PATENT NO. : 6,148,165
DATED : November 14, 2000
INVENTOR(S) : Susan A. Visser, et al.

It is certified that error appears in the above-identified patent and that said Letters Patent is hereby corrected as shown below:

Claim 2,
Line 29, delete [charge on the] and insert -- charged --.

Claim 14,
Line 13, after "carbon", enter -- outermost --.

Claim 16,
Line 4, after "of", enter -- said outermost --.

Signed and Sealed this

Twenty-third Day of October, 2001

*Attest:*

Nicholas P. Godici

NICHOLAS P. GODICI
*Acting Director of the United States Patent and Trademark Office*

*Attesting Officer*